US011365733B2

(12) United States Patent
Gutberlet et al.

(10) Patent No.: US 11,365,733 B2
(45) Date of Patent: Jun. 21, 2022

(54) SCROLL COMPRESSOR HAVING INTERNAL FIXED SCROLL WITH PILLAR DESIGN

(71) Applicant: Hanon Systems, Daejeon (KR)

(72) Inventors: Dirk Gutberlet, Würselen (DE); Kadir Dursun, Hürth (DE); Michael Friedl, Pulheim (DE)

(73) Assignee: HANON SYSTEMS, Daejeon (KR)

( * ) Notice: Subject to any disclaimer, the term of this patent is extended or adjusted under 35 U.S.C. 154(b) by 7 days.

(21) Appl. No.: 16/848,066

(22) Filed: Apr. 14, 2020

(65) Prior Publication Data

US 2021/0239116 A1 Aug. 5, 2021

Related U.S. Application Data

(60) Provisional application No. 62/969,805, filed on Feb. 4, 2020.

(51) Int. Cl.
*F04C 18/02* (2006.01)
*F04C 29/12* (2006.01)

(52) U.S. Cl.
CPC ..... *F04C 18/0215* (2013.01); *F04C 18/0253* (2013.01); *F04C 18/0261* (2013.01); *F04C 29/12* (2013.01); *F04C 2250/30* (2013.01)

(58) Field of Classification Search
CPC ..... F04C 18/0215; F04C 18/0253; F04C 18/0261; F04C 29/12; F04C 2250/30
See application file for complete search history.

(56) References Cited

U.S. PATENT DOCUMENTS

2006/0222546 A1* 10/2006 Lee ..... F04C 18/0253 418/55.1
2009/0185934 A1* 7/2009 Bush ..... F04C 27/005 418/55.4
2019/0301461 A1 10/2019 Yamashita et al.

FOREIGN PATENT DOCUMENTS

DE 102020200377 A1 7/2020
DE 102019204866 A1 10/2020
JP 09042174 A * 2/1997 ..... F04C 23/008
JP 2014214736 A * 11/2014
JP 2019178674 A 10/2019
KR 20180094407 A * 8/2018
KR 102027695 B1 10/2019
WO 2019044867 A1 3/2019
WO WO-2019044867 A1 * 3/2019 ..... F04C 18/02

* cited by examiner

*Primary Examiner* — Laert Dounis
(74) *Attorney, Agent, or Firm* — Shumaker, Loop & Kendrick, LLP; James D. Miller

(57) ABSTRACT

A fixed scroll for a scroll compressor includes a plurality of pillar portions extending axially from a first face of the fixed scroll to an opposing second face thereof. Each of the plurality of the pillar portions is spaced radially outwardly of a spiral structure at least partially defining a compression chamber of the scroll compressor. The fixed scroll further includes an annular array of spaced flow openings into the compression chamber of the scroll compressor with each of the flow openings formed between adjacent ones of the pillar portions.

16 Claims, 6 Drawing Sheets

SCROLL COMPRESSOR HAVING INTERNAL FIXED SCROLL WITH PILLAR DESIGN

CROSS-REFERENCE TO RELATED APPLICATION

This patent application claims priority to U.S. Provisional Patent Application Ser. No. 62/969,805, filed on Feb. 4, 2020, the entire disclosure of which is hereby incorporated herein by reference.

FIELD OF THE INVENTION

The invention relates to a refrigerant scroll compressor for vehicle air-conditioning systems, and in this context particularly, an internal fixed scroll of the scroll compressor having a plurality of axially extending pillars configured to provide enlarged refrigerant flow openings between adjacent ones of the pillars.

BACKGROUND OF THE INVENTION

The use of refrigerant scroll compressors in motor vehicle air-conditioning systems is highly desirable, since this type of compressor has a robust structural design and can also be produced and used cost-effectively. Scroll compressors moreover operate radially to the inside, which results in a relatively short axial installation length for the compressor. An electrical refrigerant compressor can thus be designed without requiring any additional installation space compared to a mechanical refrigerant compressor.

The principle of compression of a scroll compressor consists of the fact that an orbiting scroll is moved in an oscillating manner within a fixed scroll such that a space forms between the flanks of the corresponding spiral structures of each of the scrolls, which becomes smaller from the external radial perimeter towards the center and therefore compresses the refrigerant gas that was collected at the periphery. The final compression pressure is obtained in a central axial area of the spiral structures and the refrigerant gas is axially discharged at high pressure to an axially positioned discharge chamber.

In some scroll compressor configurations the fixed scroll is formed by a portion of the housing of the scroll compressor, such as being formed by a spiral projection extending axially inwardly from an axial end portion of the housing. However, in other scroll compressors, the fixed scroll is instead provided as a separate body that is subsequently integrated into the surrounding structure of the housing at the desired position relative to the corresponding orbiting scroll.

In such independently provided fixed scroll configurations, it is common for the fixed scroll structure to further include a circumferentially extending wall surrounding the spiral structure thereof to aid in positioning the fixed scroll relative to the remainder of the scroll compressor. The circumferentially extending wall also forms a portion of the fixed scroll capable of being coupled directly to the housing of the scroll compressor.

It is common for the refrigerant to enter the space formed between the spiral structure and the surrounding circumferential wall while flowing in a radial inward direction from a portion of the housing surrounding the circumferential wall. Such radial inward flow requires flow openings to be formed in the circumferential wall of such independently provided fixed internal scrolls, which is typically accomplished by forming circular radial bores in the circumferential wall at the desired positions for introducing the refrigerant.

However, such radial bores provide numerous disadvantages in that the refrigerant generally must change direction very sharply when changing from flowing in an axial direction of the compressor to a radial direction of the compressor, which leads to a drop in pressure of the refrigerant. The manner in which the radial bores are formed also tends to result in the formation of sharp 90-degree edges where the refrigerant changes direction, which further negatively affects the flow of the refrigerant. Lastly, such radial bores are typically provided to include a relatively small flow cross-section, which leads to the radial bores presenting a flow restriction to the refrigerant when entering the compression chamber partially defined by the fixed internal scroll. Such flow restrictions and pressure drops can in turn negatively affect the performance of the scroll compressor.

It would accordingly be desirable to provide an independently provided fixed scroll structure that prevents the aforementioned flow restriction or undesired pressure drop of the refrigerant when entering a compression chamber partially defined by the fixed scroll structure.

SUMMARY OF THE INVENTION

Consonant with the present disclosure, a scroll compressor having an internal fixed scroll structure with enlarged flow openings formed between adjacent projecting portions of the fixed scroll structure has surprisingly been discovered.

According to an embodiment of the present invention, a fixed scroll for a scroll compressor comprises a plurality of pillar portions extending axially from a first face of the fixed scroll to an opposing second face thereof. Each of the plurality of the pillar portions is spaced radially outwardly of a spiral structure at least partially defining a compression chamber of the scroll compressor. The fixed scroll further comprises an annular array of spaced flow openings into the compression chamber of the scroll compressor with each of the flow openings formed between adjacent ones of the pillar portions.

According to another embodiment of the present invention, a fixed scroll for a scroll compressor comprises a circumferential wall extending axially from a first face of the fixed scroll to an opposing second face thereof. The first face is defined by an end wall of the fixed scroll. The circumferential wall extends from an outermost periphery of the end wall and surrounds a spiral structure extending axially from the end wall. The spiral structure at least partially defines a compression chamber of the scroll compressor. A plurality of discontinuous portions is formed in the circumferential wall at the second face thereof to form a plurality of pillar portions in the circumferential wall with each of the pillar portions formed between adjacent ones of the discontinuous portions. Each of the discontinuous portions forms a flow opening into the compression chamber of the scroll compressor.

According to another embodiment of the present invention, a scroll compressor for a motor vehicle air conditioning system comprises an orbiting scroll having a first spiral structure and a fixed scroll including a plurality of pillar portions extending axially from a first face of the fixed scroll to an opposing second face thereof. Each of the plurality of the pillar portions is spaced radially outwardly of a second spiral structure configured to cooperate with the first spiral structure of the orbiting scroll to define at least one compression chamber of the scroll compressor. The fixed scroll further includes an annular array of spaced flow openings into the compression chamber of the scroll compressor with each of the flow openings formed between adjacent ones of the pillar portions.

The pillar portions can have any form but are preferably circumferentially spaced cylindrical sections about a periphery of the fixed scroll. To minimize the thickness or width of the pillar portions at a certain height from the second face of the fixed scroll a reinforcement wall may be implemented between adjacent ones of the pillar portions. The height and shape of each of the reinforcement walls may be defined individually due to the manufacturing process and stiffness requirements of the fixed scroll.

BRIEF DESCRIPTION OF THE DRAWINGS

Further particulars, features and advantages of the embodiments of the invention result from the subsequent description of embodiments with reference to the associated drawings. The drawings show.

DETAILED DESCRIPTION OF EXEMPLARY EMBODIMENTS OF THE INVENTION

Figure 1:
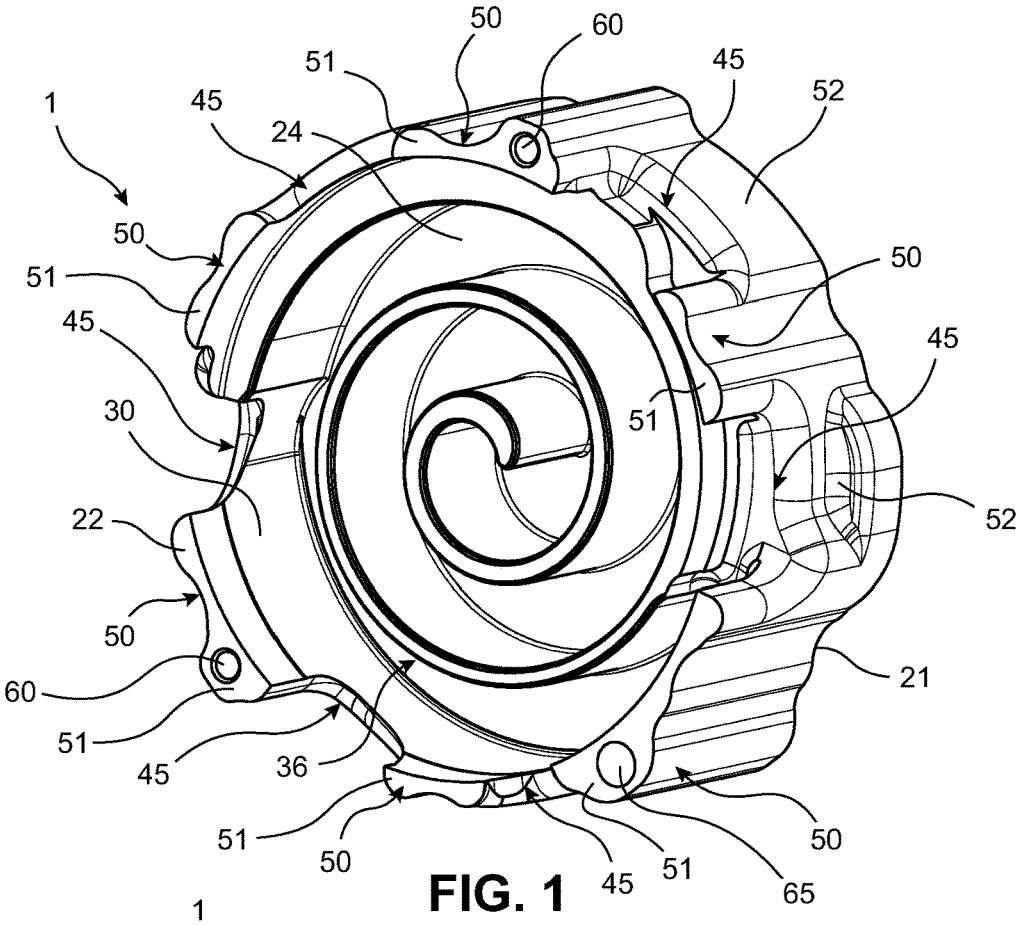
FIG. 1 is a top perspective view of a fixed scroll for use in a scroll compressor according to an embodiment of the present invention.
Figure 2:
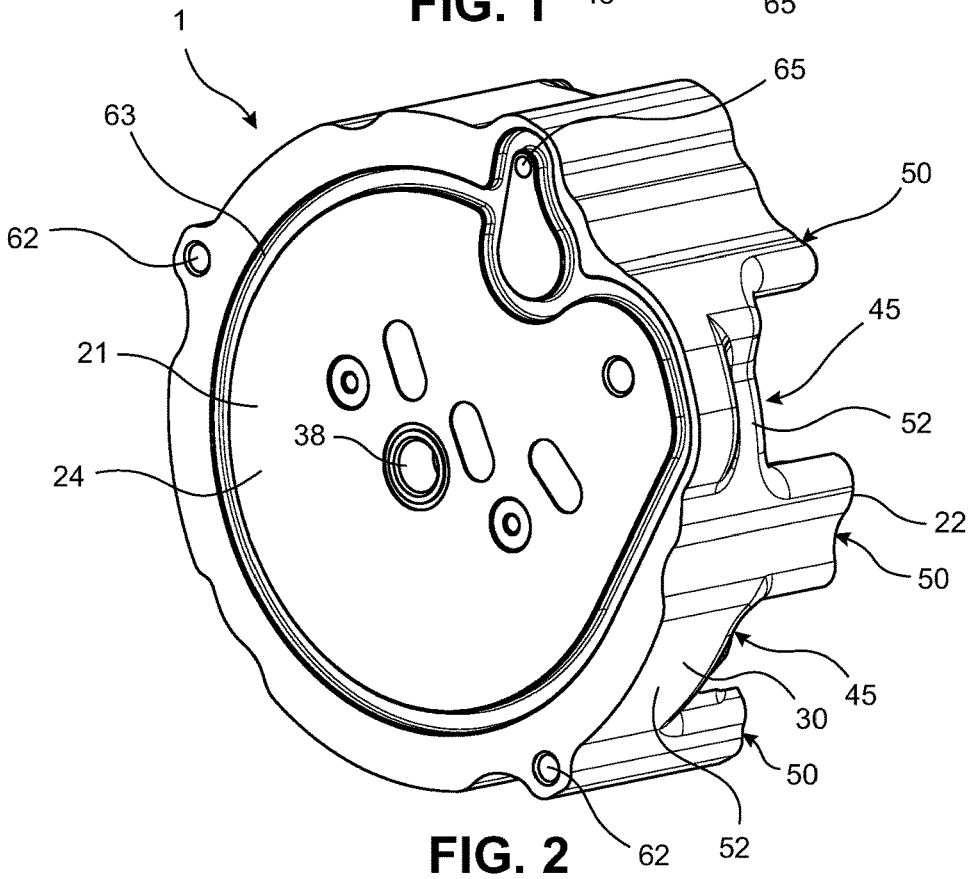
FIG. 2 is a bottom perspective view of the fixed scroll of FIG. 1.
Figure 3:
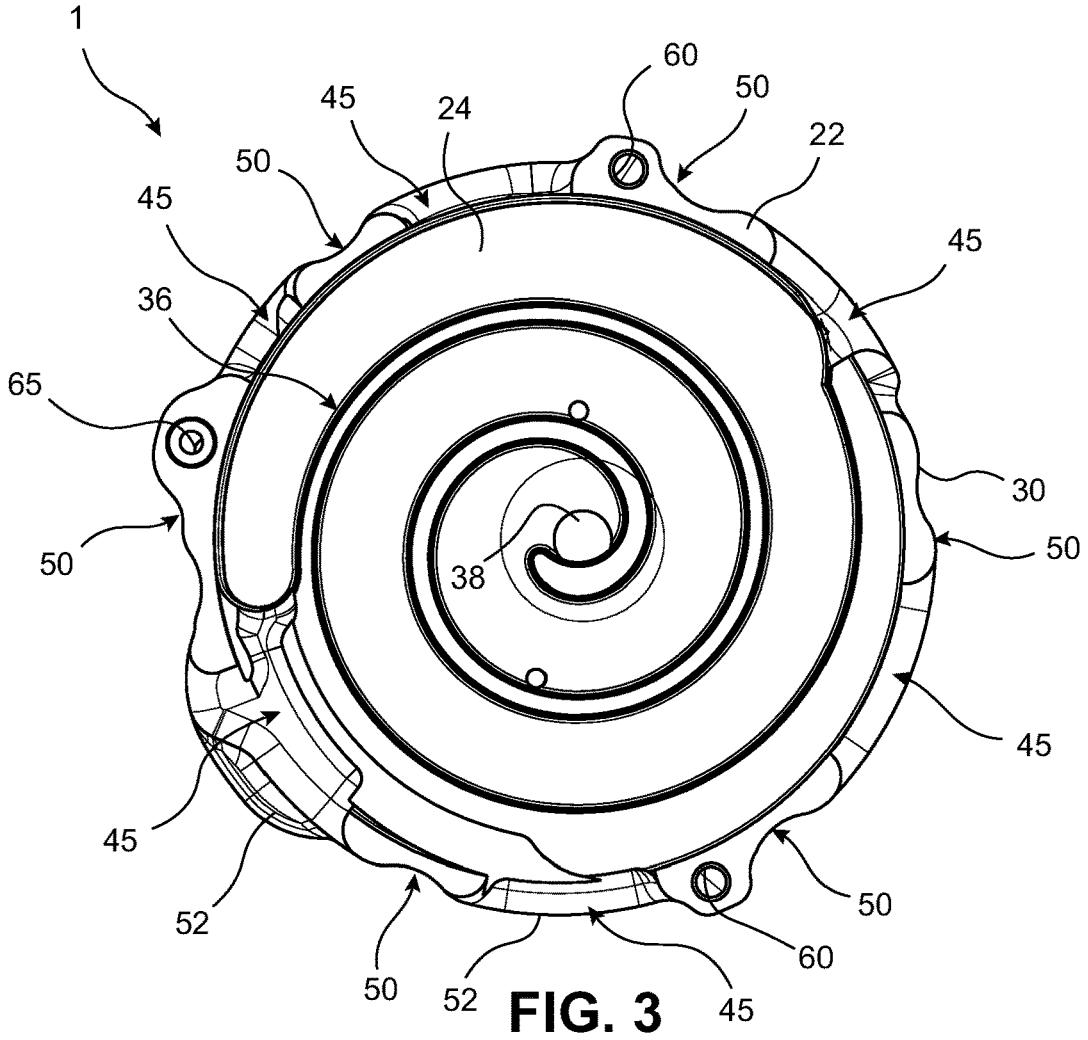
FIG. 3 is a top plan view of the fixed scroll of FIG. 1.

The following detailed description and appended drawings describe and illustrate various exemplary embodiments of the invention. The description and drawings serve to enable one skilled in the art to make and use the invention, and are not intended to limit the scope of the invention in any manner.

FIGS. 1-4 illustrate a fixed scroll 1 for use in a scroll compressor 10 according to an embodiment of the present invention. The fixed scroll 1 includes an axial end wall 24 that is generally circular in shape and includes an outer axial surface defining a first face 21 of the fixed scroll 1 with first face 21 being substantially planar in configuration. An opposing inner axial surface of the end wall 24 includes a spiral structure 36 projecting therefrom. The fixed scroll 1 further includes a plurality of pillar portions 50 extending away from the end wall 24 in an axial direction of the fixed scroll 1 with each of the pillar portions 50 spaced circumferentially from each other about the periphery of the end wall 24. The pillar portions 50 form an annular array surrounding the spiral structure 36 projecting from the end wall 24. Each of the pillar portions 50 includes a distal surface 51 spaced a maximum distance from the first face 21 of the fixed scroll 1. Each of the distal surfaces 51 of the pillar portions 50 is formed on a common plane with the circumferentially spaced apart distal surfaces 51 of the pillar portions 50 cooperating to form a second face 22 of the fixed scroll 1. Each of the pillar portions 50 accordingly extends axially from the first face 21 of the fixed scroll 1 to the opposing and parallel arranged second face 22 thereof. The distal surface 51 of each of the pillar portions 50 is spaced further from the first face 21 of the fixed scroll 1 than is a distal axial surface of the spiral structure 36 to cause the distal axial surface of the spiral structure 36 to be indented inwardly from the second face 22 of the fixed scroll 1.

The fixed scroll 1 further includes a plurality of reinforcing walls 52 provided between and connecting two adjacent ones of the pillar portions 50. Each of the reinforcing walls 52 extends axially from the end wall 24 of the fixed scroll 1 from the first face 21 of the fixed scroll 1 towards the second face 22 thereof. The reinforcing walls 52 do not extend axially all the way to the second face 22 of the fixed scroll 1 such that each of the pillar portions 50 extends axially beyond each of the reinforcing walls 52 in the axial direction from the first face 21 towards the second face 22 of the fixed scroll 1. A height of each of the reinforcing walls 52 as measured in the axial direction of the fixed scroll 1 may be individually defined and accordingly varied based on structural considerations and manufacturing process requirements of the fixed scroll 1. The reinforcing walls 52 are preferably provided to include a minimized height in the axial direction suitable for providing the desired structural integrity to the fixed scroll 1 while maximizing a flow area formed between each of the adjacent pillar portions 50 as explained in greater detail hereinafter.

As shown in FIGS. 1-4, at least some of the reinforcing walls 52 may include an increased radial thickness to aid in stiffening and strengthening the fixed scroll 1 adjacent each of the pillar portions 50. The inclusion of the reinforcement walls 52 may accordingly facilitate the formation of the pillar portions 50 having a reduced thickness in the radial direction while maintaining a robustness of the fixed scroll 1 during operation thereof. The reinforcing walls 52 may be provided to aid the pillar portions 50 in withstanding any internal pressures or other forces experienced by the fixed scroll 1 in the axial direction thereof during operation of the fixed scroll 1 within the scroll compressor 10. For example, the forces applied to the fixed scroll 1 for sealing the adjacent portions of the scroll compressor 10 thereto or the forces experienced within the spiral structure 36 during the compression of the refrigerant may be applied to the pillar portions 50 in the axial direction of the fixed scroll 1. Hence, the pillar portions 50 may be strengthened via the introduction of the reinforcement walls 52 to prevent buckling or other forms of deformation of the pillar portions 50 when subjected to especially high axial loads.

A radial outermost portion of the spiral structure 36 may be merged with one or more of the reinforcing walls 52 and/or the pillar portions 50 about the periphery of the fixed scroll 1 with the remainder of the spiral structure 36 winding radially inwardly towards a central portion thereof disposed at a central region of the end wall 24. A discharge opening 38 is formed through the end wall 24 adjacent the centermost portion of the spiral structure 36 and extends therethrough to the first face 21 of the fixed scroll 1.

The configuration of the pillar portions 50 relative to the reinforcing walls 52 results in the fixed scroll 1 including a plurality of flow openings 45 disposed about the periphery thereof with each of the flow openings 45 disposed between two adjacent ones of the pillar portions 50. More specifically, each of the flow openings 45 is defined by the outer portions of two of the pillar portions 50 and an axial end portion of one of the reinforcing walls 52 connecting the outer portions of the two of the pillar portions 50. Each of the flow openings 45 accordingly extends axially from the second face 22 of the fixed scroll 1 in a direction towards the first face 21 thereof while stopping short of the first face 21 due to the inclusion of the intervening reinforcing walls 52. Each of the flow openings 45 allows for the refrigerant to flow radially inwardly towards the spiral structure 36 when the refrigerant enters the interior of the fixed scroll 1 as explained in greater detail with reference to FIGS. 5-7.

The flow openings 45 may include any desired cross-sectional shape, including a substantially semi-circular shape, a substantially triangular shape, or a shape resembling half of a rounded rectangle, as desired. One skilled in the art should appreciate that any suitable shape allowing for passage of the refrigerant thereby may be utilized without necessarily departing from the scope of the present invention. However, it may be desired for the cross-sectional shape of each of the flow openings 45 to include a constant or progressively decreasing width when progressing away from the second face 22 and towards the first face 21 to facilitate an ease of manufacturing the fixed scroll 1. For example, the fixed scroll 1 may be formed using a suitable forging process wherein the structural shape of the fixed scroll 1 is established via a corresponding die or mold. The fixed scroll 1 may alternatively be formed by a suitable casting or molding process, as desired, without necessarily departing from the scope of the present invention. The height, thickness, and general configuration of each of the pillar portions 50 and each of the connecting reinforcing walls 52 may be selected to account for the structural characteristics of the fixed scroll 1 based on the type of manufacturing process and the material used in forming the fixed scroll 1. The fixed scroll 1 may be formed from any substantially rigid material such as a suitable metallic material. The fixed scroll 1 as disclosed herein may preferably be formed from a suitable aluminum alloy or in some cases a suitable steel alloy, as desired.

As shown throughout FIGS. 1-4, the fixed scroll 1 includes a generally arcuate contour around the periphery of each of the flow openings 45 formed therein. Specifically, the outer circumferential surface of the fixed scroll 1 as defined by the pillar portions 50 and the reinforcing walls 52 turns radially inwardly with a convex arcuate contour about the periphery of each of the flow openings 45 to prevent the formation of sharp edges or sharp turns in the geometry of the fixed scroll 1. These sharp turns are avoided as they may lead to a pressure drop or flow restriction to the refrigerant when entering the fixed scroll 1 through one of the flow openings 45 while flowing in the radially inward direction of the fixed scroll 1.

The configuration of the fixed scroll 1 as described thus far may alternatively be described as including a circumferential wall projecting axially from an outermost periphery of the end wall 24 at a position surrounding the spiral structure 36 thereof, wherein the circumferential wall is formed by the cooperation of the merged together pillar portions 50 and reinforcing walls 52 as they alternatingly extend around the periphery of the end wall 24. The flow openings 45 therefore are provided as discontinuous portions of the circumferential wall formed at the second face 22 of the fixed scroll 1, wherein each of the discontinuous portions resembles an axially extending indentation extending from the second face 22 of the fixed scroll 1 in a direction towards the first face 21 thereof. Each of the indentations forming the discontinuous portions is accordingly axially aligned with one of the aforementioned reinforcing walls 52 while each of the aforementioned pillar portions 50 are formed by the portions of the circumferential wall disposed between adjacent ones of the discontinuous portions.

The fixed scroll 1 is preferably formed with at least three of the pillar portions 50 to ensure a stable configuration of the fixed scroll 1 when inserted into a corresponding housing of the scroll compressor 10. In the provided embodiment, the fixed scroll 1 includes six of the pillar portions 50 as separated by six of the flow openings 45. The ratio of the circumference of the fixed scroll 1 occupied by the pillar portions 50 in comparison to the flow openings 45 at the second face 22 of the fixed scroll 1 may be any suitable ratio, but about a 1 to 1 ratio is disclosed in FIGS. 1-4. More specifically, the embodiment illustrated in FIGS. 1-4 includes the pillar portions 50 occupying about 53.5% of the total circumference of the fixed scroll 1 at the second face 22 thereof, wherein the other 46.5% of the total circumference is occupied by the flow openings 45 at the second face 22. However, the circumferential ratio of the pillar portions 50 to the flow openings 45 at the second face 22 may be as high as 4 to 1 (80% of the total circumference of the fixed scroll 1) while still providing the benefits of the invention as disclosed herein regarding the lack of flow restriction and pressure drop of the refrigerant when entering the fixed scroll 1 in the radial inward direction. The described ratio may alternatively be described as the discontinuous portions of the combined circumferential wall formed by the cooperation of the pillar portions 50 and the reinforcing walls 52 occupying 180 degrees or less of the total circumference of the combined circumferential wall present at the second face 22 of the fixed scroll 1.

Figure 4:
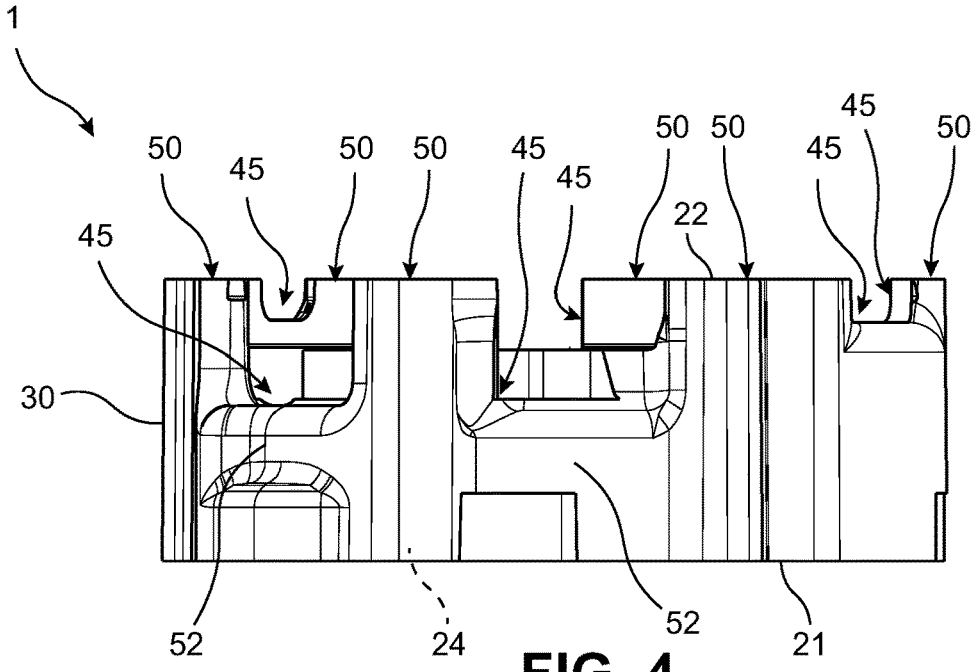
FIG. 4 is a side elevational view of the fixed scroll of FIG. 1.

As shown in FIG. 4, at least one of the flow openings 45 may extend at least one third of the total axial distance between the first face 21 and the second face 22. Specifically, the at least one of the flow openings 45 having the greatest axial extension may extend around 45% of the total distance between the opposing faces 21, 22, as desired. The different flow openings 45 may include varying axial extensions depending on the desired flow of the refrigerant into the interior of the fixed scroll 1 and the structural requirements of the fixed scroll 1 for withstanding the axial forces applied to the fixed scroll 1 during operation thereof.

The fixed scroll 1 further includes at least two coupler openings 60 extending axially into the fixed scroll 1 from the second face 22 towards the first face 21. Each of the pair of the coupler openings 60 may be formed within the distal surface 51 of one of the pillar portions 50, wherein those pillar portions 50 having one of the coupler openings 60 may include a greater overall thickness in the radial direction of the fixed scroll 1 to accommodate the reduced thickness of the corresponding pillar portions 50 about a perimeter of each of the coupler openings 60. In the disclosed embodiment, the coupler openings 60 are separated from one another by an intermediate disposed one of the pillar portions 50, but any distribution of the coupler openings 60 among the pillar portions 50 may be utilized without necessarily departing from the scope of the present invention, so long as the coupler openings 60 are suitably placed for preventing undesired rotation or translation of the fixed scroll 1 when installed relative to the remainder of the scroll compressor 10.

In the disclosed embodiment, the coupler openings 60 extend through only a portion of each of the pillar portions 50 with respect to the axial direction of the fixed scroll 1 such that the coupler openings 60 do not penetrate the entirety of the fixed scroll 1 to the first face 21 thereof. The coupler openings 60 may have any desired depth and shape for accommodating a corresponding coupler, as desired. The coupler openings 60 are also shown as being substantially circular in cross-section to cause each of the coupler openings 60 to be substantially cylindrical in shape. However, the coupler openings 60 may have any cross-sectional shape suitable for engaging a corresponding coupler, as desired, as explained in greater detail with reference to FIG. 5.

The first face 21 of the fixed scroll 1 further includes a pair of locating openings 62 formed therein and extending in an axial direction of the fixed scroll 1 towards the second face 22 thereof. The locating openings 62 are shown as being formed directly opposite the disclosed coupler openings 60, but the opposing openings 60, 62 do not meet each other within the body 20 of the fixed scroll 1 with respect to the axial direction thereof (illustrated in FIG. 5). The locating openings 62 are instead provided to properly position the fixed scroll 1 during a manufacturing process carried out thereon, and are accordingly optional and not necessary for the fixed scroll 1 to operate in the manner disclosed herein.

The first face 21 of the fixed scroll 1 is also depicted as including a seal groove 63 penetrating the first face 21 at least partially in the axial direction towards the second face 22 thereof, but not to an extent for penetrating the end wall 24. The seal groove 63 is configured to receive a seal 64 (illustrated in FIGS. 5 and 7) that is configured for compression between the first face 21 and an adjoining surface of the scroll compressor 10. The seal groove 63 primarily extends around a periphery of the first face 21 and further includes a closed loop portion surrounding a pressure regulating opening 65. The pressure regulating opening 65 extends axially through an entirety of the fixed scroll 1 from the first face 21 to the second face 22 thereof. The pressure regulating opening 65 is configured to communicate a portion of the refrigerant between the first face 21 and the second face 22 of the fixed scroll 1 for regulating the pressure at desired locations within the scroll compressor 10 as is conventional in the art. The closed loop portion of the seal groove 63 and the corresponding seal 64 are accordingly disposed to surround the pressure regulating opening 65 in order to prevent undesired communication of the refrigerant between the discharge opening 38 and the pressure regulating opening 65 at positions adjacent the first face 21 of the fixed scroll 1. The pressure regulating opening 65 is provided as a cylindrical opening that is disposed through an enlarged portion of one of the pillar portions 50 of the fixed scroll 1 in similar fashion to each of the coupler openings 60, whereby the enlarged portion of the corresponding pillar portion 50 is again provided to stabilize and strengthen the pillar portion 50 against deformation in reaction to axial forces acting on the fixed scroll 1.

Figure 5:
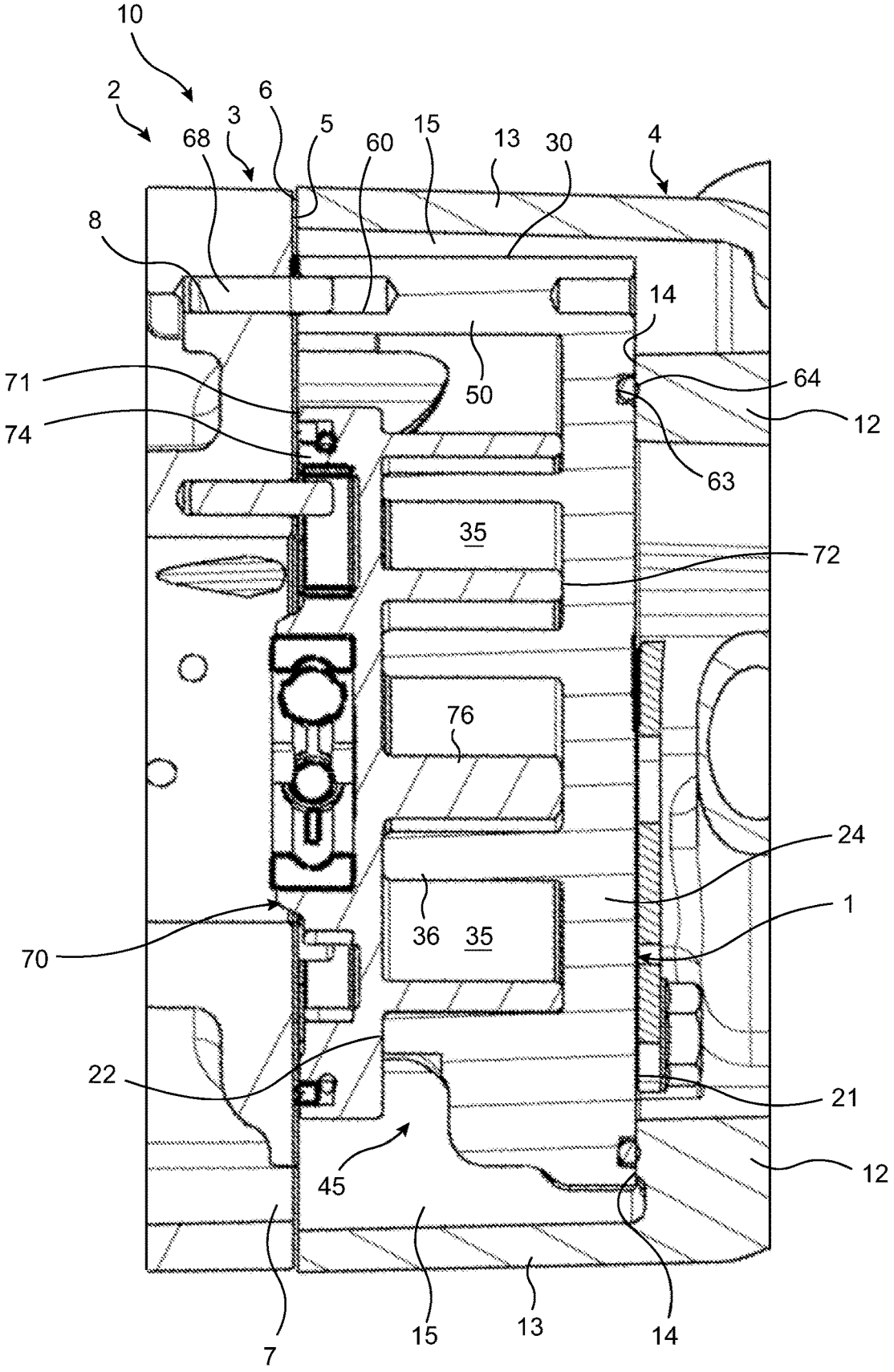
FIG. 5 is a fragmentary elevational cross-sectional view taken through a scroll compressor having the fixed scroll of FIGS. 1-4 installed operationally therein.
Figure 6:
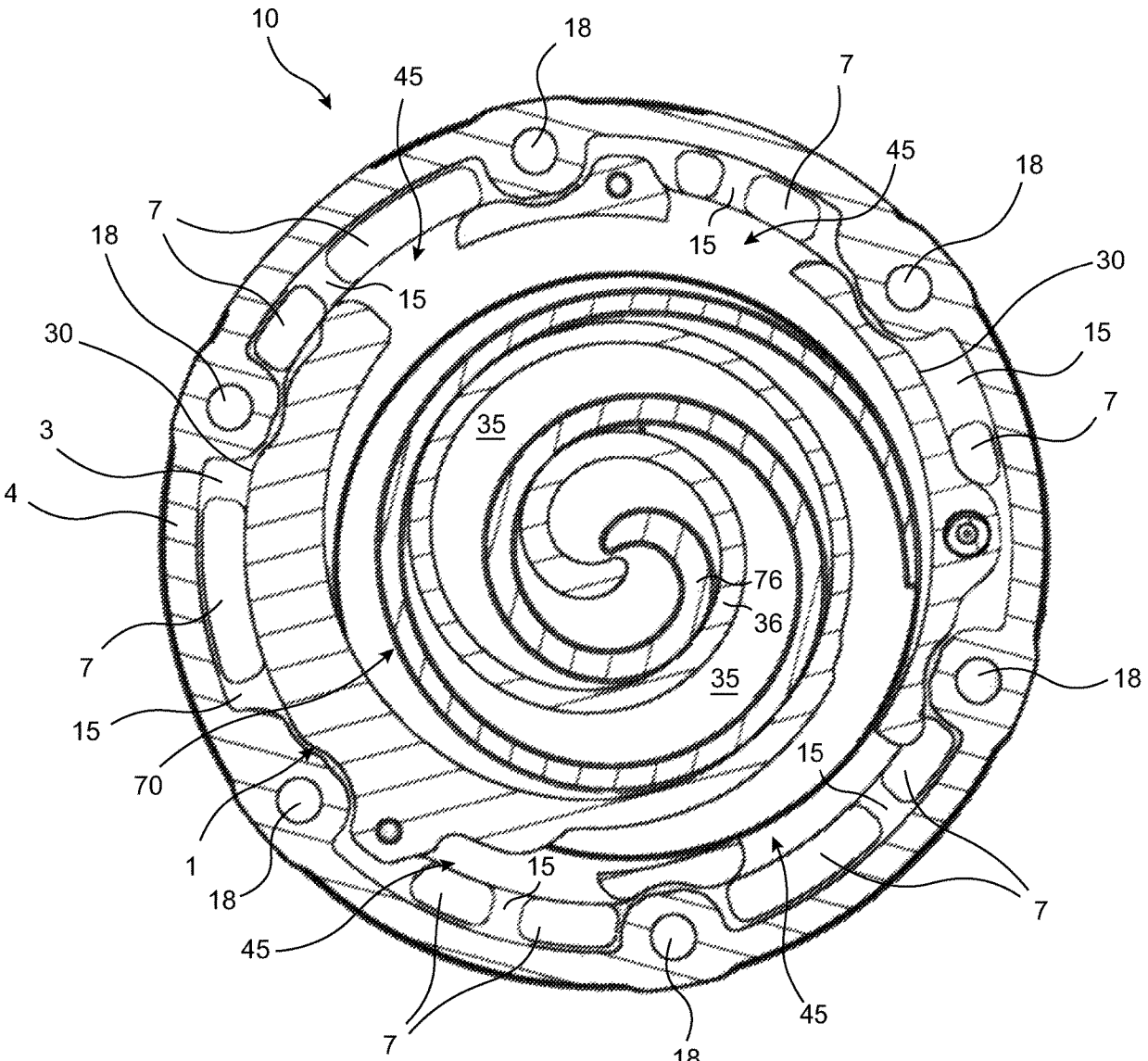
FIG. 6 is an elevational cross-sectional view taken through the fixed scroll, an orbiting scroll, and a housing portion of the scroll compressor into which the fixed scroll is disposed, wherein the perspective of FIG. 6 is directed towards another housing portion of the scroll compressor to which the fixed scroll is coupled when in the operational position of FIG. 5.
Figure 7:
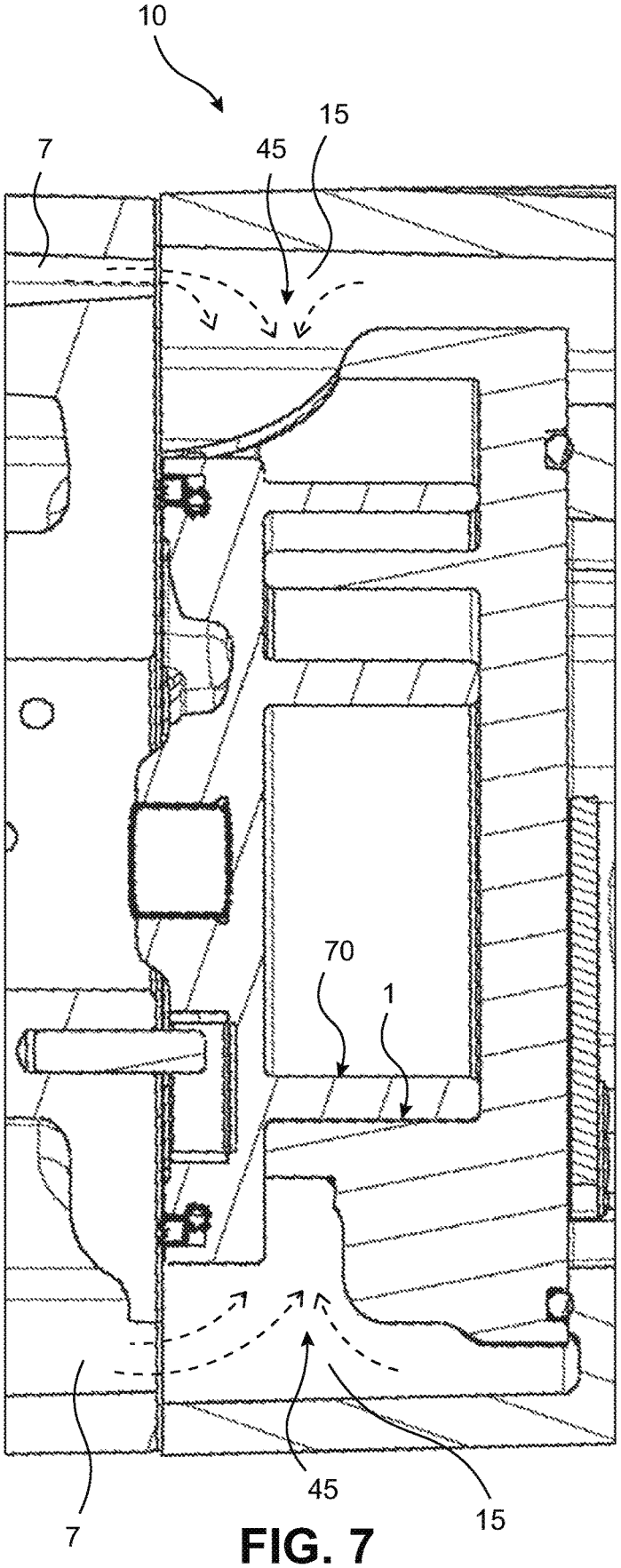
FIG. 7 is a fragmentary elevational cross-sectional view of the scroll compressor of FIG. 5 taken through a portion of the fixed scroll forming flow openings on opposite sides of the fixed scroll.

Referring now to FIGS. 5-7, one exemplary installation of the fixed scroll 1 relative to the scroll compressor 10 is disclosed with only those portions of the scroll compressor 10 necessary for disclosing the beneficial features of the fixed scroll 1 according to the current invention being illustrated. The relevant portions of the scroll compressor 10 disposed adjacent the fixed scroll 1 generally include a housing 2 of the scroll compressor 10 and an orbiting scroll 70 configured to mate with the fixed scroll 1 for compressing the refrigerant therebetween.

The orbiting scroll 70 extends axially from a first face 71 to an opposing and spaced apart second face 72. The first face 71 and the second face 72 are each substantially planar in configuration and are arranged parallel to each other. The first face 71 of the orbiting scroll 70 forms an end wall 74 of the orbiting scroll 70 configured to delimit a flow of the refrigerant in the axial direction thereof when flowing between the orbiting scroll 70 and the fixed scroll 1. A spiral structure 76 projects axially away from the end wall 74 with a distally arranged surface of the spiral structure 76 forming the second face 72 of the orbiting scroll 70.

As best shown with reference to FIG. 6, which illustrates a cross-sectional view through each of the spiral structures 36, 76 of the respective scrolls 1, 70, the spiral structure 76 of the orbiting scroll 70 is interposed within the spaces formed within the spiral structure 36 of the fixed scroll 1 to form a nested configuration. As is conventional in the art, the orbiting scroll 70 is configured to orbit relative to the fixed scroll 1 such that two opposing cavities are continuously formed between the interposed spiral structures 36, 76 with the cavities progressively decreasing in volume as the cavities progress radially inwardly towards the central regions of each of scrolls 1, 70. This decreasing flow volume causes the refrigerant gas to be continually compressed until the compressed refrigerant gas is finally discharged axially through the discharge opening 38 located at the center of the spiral structures 36, 76. The orbiting scroll may be coupled to a rotating shaft capable of causing the orbiting motion of the orbiting scroll, as desired. The cavities formed between the orbiting scroll 70 and the fixed scroll 1 are hereinafter referred to as compression chambers 35 of the scroll compressor 10, wherein each of the compression chambers 35 is at least partially defined by the spiral structure 76 of the orbiting scroll 70 as well as the spiral structure 36 of the fixed scroll 1. The aforementioned radial flow of the refrigerant into the interior of the fixed scroll 1 accordingly corresponds to the refrigerant flowing towards an entrance into one of the aforementioned compression chambers 35 while flowing through one of the flow openings 45.

The housing 2 generally includes a first housing portion 3 and a second housing portion 4. In some embodiments, the first housing portion 3 may represent a center housing of the scroll compressor 10 while the second housing portion 4 may represent a rear housing of the scroll compressor 10, as desired. The first housing portion 3 includes a substantially planar first end 5 configured to engage the second face 22 of the fixed scroll 1 as formed by the distal surfaces 51 of the pillar portions 50 while also disposed immediately adjacent the first face 71 of the orbiting scroll 70. The first end 5 of the first housing portion 3 accordingly defines a portion of the periphery of each of the flow openings 45 on the plane defined by the second face 22 of the fixed scroll 1. The first end 5 of the first housing portion 3 is further configured to engage a first end 6 of the second housing portion 4 about a periphery of the scroll compressor 1 along substantially the same plane occupied by the second face 22 of the fixed scroll 1 and the first face 71 of the orbiting scroll 70.

As shown in each of FIGS. 5-7, the first housing portion 3 includes a plurality of axially extending refrigerant communication passages 7 formed therein and terminating at the first end 5 of the first housing portion 3. Each of the refrigerant communication passages 7 is provided to allow for the refrigerant to flow axially through the scroll compressor 10 towards the position of the fixed scroll 1 and the orbiting scroll 70, hence an upstream end (not shown) of each of the refrigerant communication passages 7 is in fluid communication with a refrigerant inlet port (not shown) into the scroll compressor 10. The refrigerant communication passages 7 terminate at the first end 5 of the first housing portion 3 at positions disposed immediately radially outward of the outer circumferential surface of the pillar portions 50 in a manner allowing the refrigerant conveyed through the refrigerant communication passages 7 to flow axially before turning smoothly into the flow openings 45. As best shown in FIG. 6, the refrigerant communication passages 7 may be distributed circumferentially around the outer circumferential surface of the fixed scroll 1 as formed by the pillar portions 50 and the reinforcing walls 52 in a manner allowing for the refrigerant to flow through one of the circumferentially spaced flow openings 45 without having to flow an undesired distance in the circumferential direction of the fixed scroll 1 to a circumferentially spaced one of the flow openings 45, which could otherwise lead to an additional change in direction and resulting loss in pressure of the refrigerant when flowing towards the flow openings 45.

The refrigerant communication passages 7 may be provided as voids formed in the first housing portion 3 as illustrated throughout FIGS. 5-7 or the refrigerant communication passages 7 may be formed as spaces provided between a radial inner segment of the first housing portion 3 and a radial outer segment thereof, as desired. One skilled in the art should appreciate that any configuration of the refrigerant communication passages 7 may be utilized so long as the refrigerant is capable of being delivered to the outer circumferential surface of the fixed scroll 1 while flowing substantially axially through the scroll compressor 10 in a manner preventing an undesirable flow restriction or pressure drop in the refrigerant.

The first housing portion 3 further includes at least two openings 8 formed therein at positions corresponding to and axially aligned with the at least two of the coupler openings 60 penetrating the second face 22 of the fixed scroll 1. Each of the openings 8 may have any suitable cross-sectional shape corresponding to that of the coupler openings 60 to allow for a coupler 68 to extend at least partially through each aligned set of the openings 8 and the coupler openings 60. In the provided embodiment, each of the couplers 68 is a cylindrical pin with a circular cross-sectional shape that is inserted at least partially into one of the openings 8 and at least partially into one of the coupler openings 60 with respect to the axial direction of the fixed scroll 1, as shown with reference to FIG. 5. The use of at least two of the couplers 68 through at least two aligned sets of the openings 8 and the coupler openings 60 accordingly prevents undesired translation of the fixed scroll 1 relative to the first housing portion 3 with respect to any of the radial directions of the fixed scroll 1 as well as preventing an undesired rotation of the fixed scroll 1 relative to the first housing portion 3. As mentioned previously, it should be apparent that the openings 8 and the coupler openings 60 may include any desired cross-sectional shape while still being capable of preventing the translation and the rotation of the fixed scroll 1 relative to the remainder of the scroll compressor 10.

The second housing portion 4 generally includes an inner portion 12 and an outer portion 13. The inner portion 12 includes an engaging surface 14 arranged parallel to and placed in contact with the first face 21 of the fixed scroll 1. The outer portion 13 extends axially from a periphery of the inner portion 12 and is positioned radially outward of the outer surface of the circumferential wall 30 about a circumference thereof. The outer portion 13 is radially spaced apart from the outer circumferential surface of the fixed scroll 1 at a plurality of circumferentially spaced positions to form a plurality of refrigerant flow chambers 15 about the periphery of the fixed scroll 1. Each of the refrigerant flow chambers 15 is placed in direct fluid communication with at least one of the refrigerant communication passages 7 as well as at least one of the flow openings 45 into the fixed scroll 1.

The second housing portion 4 may be coupled to the first housing portion 3 via a plurality of circumferentially spaced threaded fasteners 18 extending axially through the outer portion 13 of the second housing portion 4 and the periphery of the first housing portion 3. The threaded fasteners 18 may be tightened to compress the fixed scroll 1 in the axial direction between the first end 6 of the first housing portion 3 and the engaging surface 14 formed by the inner portion 12 of the second housing portion 4. This axial compression of the fixed scroll 1 between the first housing portion 3 and the second housing portion 4 affixes an axial position of the fixed scroll 1 within the scroll compressor 10 while also compressing the seal 64 present between the first face 21 of the fixed scroll 1 and the engaging surface 14 of the second housing portion 4. The fixed scroll 1 is accordingly restrained from undesired movement relative to the housing 2 of the scroll compressor 10 while also positioned for allowing the refrigerant to flow towards the flow openings 45 formed in the circumferential wall 30 of the fixed scroll 1.

The fixed scroll 1 may be provided to include the same number of the pillar portions 50 as there are axially extending threaded fasteners 18 used to maintain the axial position of the fixed scroll 1 between the first housing portion 3 and the second housing portion 4. For example, the embodiment illustrated in FIGS. 5-7 includes six of the pillar portions 50 and six of the threaded fasteners 18. However, the number of the pillar portions 50 may be selected to be greater than or fewer than the number of the threaded fasteners 18, as desired. Additionally, each of the pillar portions 50 may preferably be positioned circumferentially about the periphery of the fixed scroll 1 to substantially correspond to the circumferential position of each of the threaded fasteners 18, as desired. However, the pillar portions 50 may alternatively be freely positioned relative to the position of each of the threaded fasteners 18 without necessarily departing from the scope of the present invention, as desired. It is also desirable for each of the pillar portions 50 to extend axially in a direction parallel to the direction of extension of each of the threaded fasteners 18 in order to improve the force transduction to the fixed scroll 1, which in turn minimizes the deformation of the fixed scroll 1 when compressed axially between the first housing portion 3 and the second housing portion 4.

The scroll compressor 10 operates as follows. The refrigerant enters the scroll compressor 10 and eventually flow axially through the refrigerant communication passages 7 towards the flow chambers 15 disposed radially outwardly of the fixed scroll 1. As best shown in FIG. 7, the relatively large flow openings 45 allow for the refrigerant to flow smoothly and continuously while turning from the axial direction to the radial direction when entering each of the flow openings 45. The smooth convex surfaces formed about a periphery of each of the flow openings 45 further prevents the refrigerant from having to turn quickly about any undesirably sharp edges. The refrigerant is able to enter the interior of the fixed scroll 1 via any of the plurality of the flow openings 45 in a manner allowing for the refrigerant to flow towards either of the two opposing entrances into one of the compression chambers 35 defined at least partially by each of the cooperating spiral structures 36, 76 without once again having to turn an undesirable degree within the interior of the fixed scroll 1. The refrigerant is then compressed via the orbiting of the orbiting scroll 70 in the conventional manner until the refrigerant is discharged from the discharge opening 38 formed at the center of each of the cooperating spiral structures 36, 76.

The use of the fixed scroll 1 having the axially extending flow openings 45 provides numerous advantages over the fixed scrolls of the prior art. The elimination of the formation of sharp radially extending bores through a circumferential wall of a fixed scroll prevents an undesirable sharp change in direction of the refrigerant during entry into the compression chambers of the corresponding fixed scroll. The use of flow openings 45 beginning at an axial end face 22 of the fixed scroll 1 also greatly enlarges the total flow area into the interior of the fixed scroll 1 for preventing an undesired flow restriction in the refrigerant while also providing for an enlarged axial distance for the refrigerant to more gradually turn from the axial direction to the radial direction of the fixed scroll 1. These advantages lead to an improved performance of the scroll compressor 10 due to the refrigerant having an increased flow rate as well as an increased pressure when entering the compression chambers 35 formed between the scrolls 1, 70.

It should be apparent to one skilled in the art that various features of the fixed scroll 1 as well as the remainder of the corresponding scroll compressor 10 may be slightly modified from the embodiment disclosed throughout FIGS. 1-7 without altering the advantageous features provided by the use of the pillar portions 50 for forming the flow openings 45 as disclosed herein. For example, the couplers 68 are shown and described as being independently provided pins that are located at least partially in each of the openings 8, 60, but the couplers 68 may alternatively be provided as integrally formed projections extending axially from either of the second face 22 of the fixed scroll 1 or the first end 5 of the first housing portion 3 without altering the method of installation of the fixed scroll 1 into the scroll compressor 10. The fixed scroll 1 may also be formed with the coupler openings 60 extending axially through an entirety of the fixed scroll 1 from the first face 21 to the opposing second face 22 thereof in a manner allowing for a threaded fastener such as a bolt to extend through the fixed scroll 1 and be received into a corresponding one of the openings 8 formed in the first portion 3 of the housing 2. The openings 8 may accordingly be threaded to allow the threaded fastener to be received at a desired depth for axially compressing the fixed scroll 1 to the first end 5 of the first housing portion 3 in order to restrain the fixed scroll 1 in the axial direction as well as any radial direction thereof, assuming that at least two of the threaded fasteners are utilized.

The axially extending couplers 68 may also be replaced with radially extending couplers penetrating the outer portion 13 of the second housing portion 4 as well as a portion of the outer circumferential surface of the fixed scroll 1 as formed by the pillar portions 50 and the reinforcing walls 52. Lastly, the fixed scroll 1 may be installed and maintained in position between the first housing portion 3 and the second housing portion 4 without the use of the couplers, such as by forming cooperating grooves and projections between the outer circumferential surface of the fixed scroll 1 and the inner surface of the outer portion 13 of the second housing portion 4. For example, a plurality of interlocking splines may be formed on the aforementioned surfaces in a manner locating the position of the fixed scroll 1 in the scroll compressor 10 while preventing undesired translation or rotation thereof relative to the second housing portion 4. One skilled in the art will appreciate that alternative methods and structures for affixing the position of the fixed scroll 1 within the scroll compressor 10 may also be utilized while appreciating the above described advantages of the enlarged and smoothly formed flow openings 45 into the interior of the fixed scroll 1.

Figure 8:
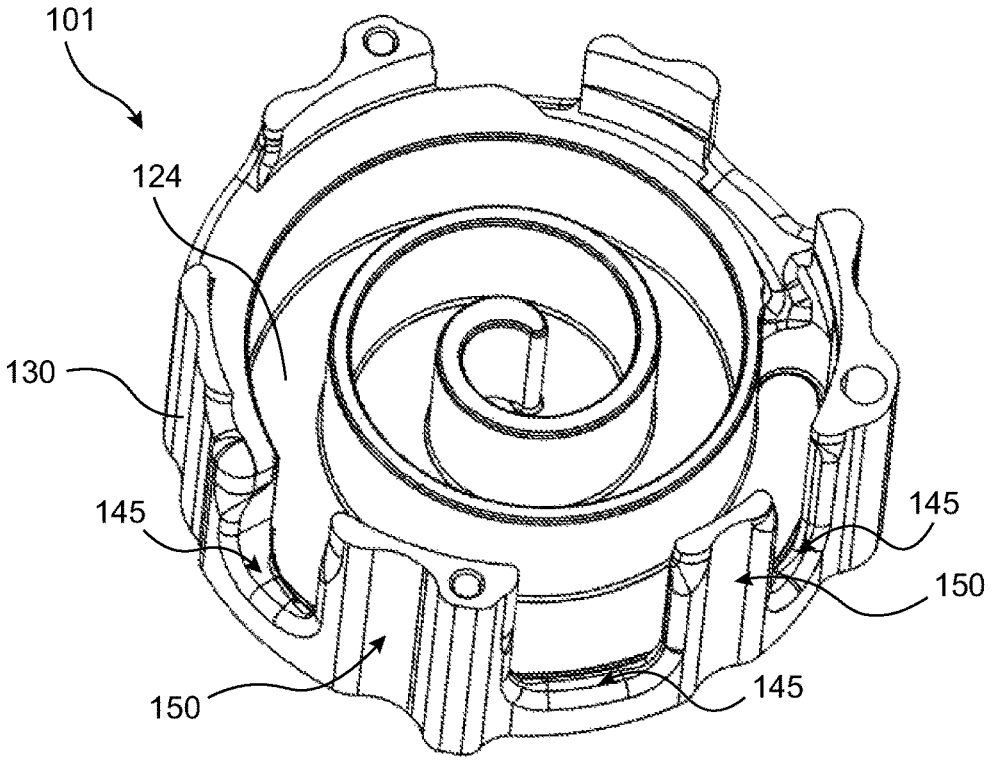
FIGS. 8 and 9 are top perspective views of a fixed scroll according to another embodiment of the invention having flow openings that are extended axially in comparison to the flow openings of the fixed scroll of FIGS. 1-7.
Figure 9:
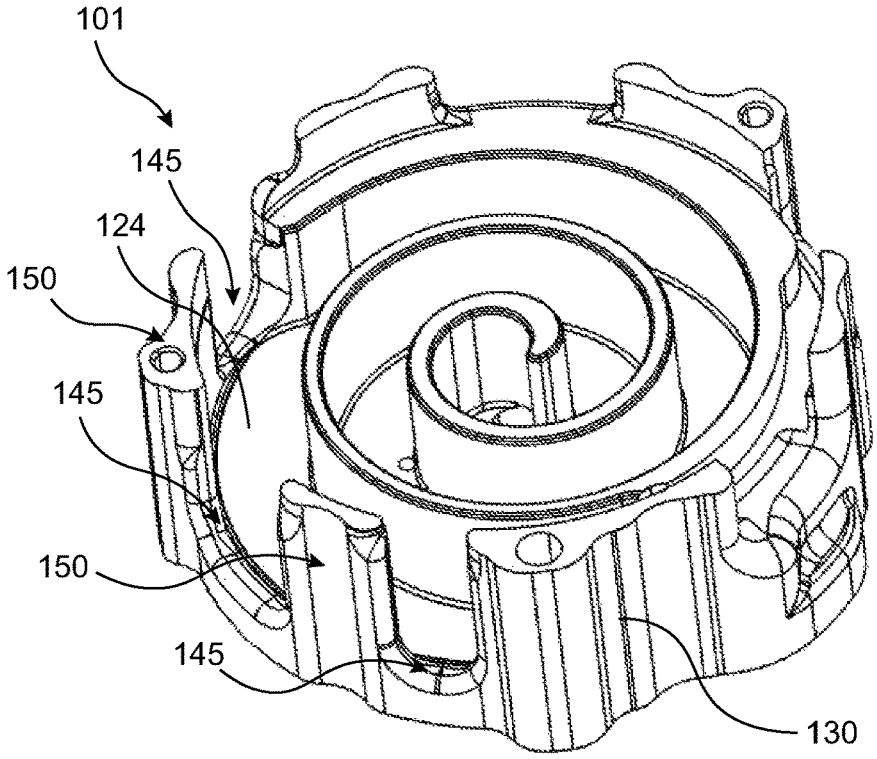

Referring now to FIGS. 8 and 9, a fixed scroll 101 according to another embodiment of the present invention is disclosed. The fixed scroll 101 is substantially identical to the fixed scroll 1 shown and described with reference to FIGS. 1-7 with the exception of the fixed scroll 101 including substantially enlarged flow openings 145 into the fixed scroll 101 in comparison to the flow openings 45 of the fixed scroll 1. The enlarged flow openings 145 may be formed to extend over half an axial distance between the opposing faces of the fixed scroll 101 to further increase the axial distance the refrigerant is able to turn radially inwardly while also increasing the flow area into the interior of the fixed scroll 101. Specifically, at least some of the flow openings 145 extend axially to an end wall 124 of the fixed scroll 101 in the absence of one of the reinforcing walls connecting adjacent ones of the pillar portions 150 in the circumferential direction of the fixed scroll 101. Stated otherwise, a circumferential wall of the fixed scroll 101 projecting axially from an outermost periphery of the end wall 124 between a first face and an opposing second face of the fixed scroll 101 may include discontinuous portions projecting axially from the second face all the way to the portion of the circumferential wall coinciding with the end wall 124, thereby eliminating the presence of one of the reinforcing walls between adjacent ones of the pillar portions 150 with respect to these axially lengthened discontinuous portions.

The fixed scroll 101 may be utilized in circumstances wherein the flow rate through the corresponding scroll compressor is desired to be maximized while the axial loads applied to the fixed scroll 101 are not great enough to cause a buckling or other deformation of the lengthened pillar portions 150 of the fixed scroll 101. The fixed scroll 101 may be installed into the corresponding scroll compressor utilizing any of the methods and structures disclosed herein. The fixed scroll 101 also operates in identical fashion to the fixed scroll 1 with the exception of the reduced flow restriction through the fixed scroll 101 in comparison to the fixed scroll 1.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A fixed scroll for a scroll compressor comprising:

a plurality of pillar portions extending axially from a first face of the fixed scroll to an opposing second face thereof, each of the plurality of the pillar portions spaced radially outwardly of a spiral structure at least partially defining a compression chamber of the scroll compressor;

an annular array of spaced flow openings into the compression chamber of the scroll compressor with each of the flow openings formed between adjacent ones of the pillar portions, wherein the fixed scroll further comprises at least one reinforcing wall extending axially from the first face towards the second face of the fixed scroll, wherein each of the at least one reinforcing walls is formed between and connects adjacent ones of the pillar portions, wherein the fixed scroll further comprises an arcuate and convex surface extended radially inwardly at a boundary of one of the flow openings, wherein the arcuate and convex surface is formed in the pillar portions and the at least one reinforcing wall, wherein a rapid rotation, consequent pressure drop and flow restriction during radial rotation from axial direction as refrigerant enters through the flow openings are prevented by the arcuate and convex surface formed in the reinforcing wall, wherein a rapid rotation, consequent pressure drop and flow restriction during radial rotation from circumferential direction as refrigerant enters through the flow openings are prevented by the arcuate and convex surfaces formed in the pillar portions, wherein at least one of the flow openings having a greatest axial extension extends axially through at least one third of a total axial distance between the first face and the second face, and different flow openings have an axial extension different from the greatest axial extension of the at least one of the flow openings.

2. The fixed scroll of claim 1, wherein the fixed scroll is formed in a forging process.

3. The fixed scroll of claim 1, wherein each of the flow openings has a constant or a progressively decreasing circumferential width as each of the flow openings progresses away from the second face and towards the first face.

4. The fixed scroll of claim 1, wherein at least one of the flow openings extends axially through at least half of a total axial distance between the first face and the second face.

5. The fixed scroll of claim 1, wherein a ratio of the flow openings relative to the pillar portions around a circumference of the fixed scroll at the second face thereof is between 1 to 4 and 1 to 1.

6. The fixed scroll of claim 1, wherein the at least one reinforcing wall has an increased thickness in the radial direction of the fixed scroll in comparison to the two adjacent ones of the pillar portions.

7. The fixed scroll of claim 1, wherein at least one of the pillar portions includes an axially extending opening formed therein from the second face towards the first face, wherein the axially extending opening is configured to receive a coupler therein for coupling the fixed scroll to a housing of the scroll compressor.

8. The fixed scroll of claim 1, wherein the plurality of pillar portions includes at least three of the pillar portions.

9. A fixed scroll for a scroll compressor comprising:

a circumferential wall extending axially from a first face of the fixed scroll to an opposing second face thereof, the first face defined by an end wall of the fixed scroll, the circumferential wall extending from an outermost periphery of the end wall and surrounding a spiral structure extending axially from the end wall, the spiral structure at least partially defining a compression chamber of the scroll compressor, a plurality of discontinuous portions formed in the circumferential wall at the second face thereof to form a plurality of pillar portions in the circumferential wall with each of the pillar portions formed between adjacent ones of the discontinuous portions, wherein each of the discontinuous portions forms a flow opening into the compression chamber of the scroll compressor, wherein the circumferential wall further includes at least one reinforcing wall axially aligned with one of the discontinuous portions of the at least one reinforcing wall connecting two adjacent ones of the pillar portions to each other with respect to the circumferential direction of the circumferential wall, wherein the fixed scroll further comprises an arcuate and convex surface extended radially inwardly at a boundary of one of the flow openings, wherein the arcuate and convex surface is formed in the pillar portions and the at least one reinforcing wall, wherein a rapid rotation, consequent pressure drop and flow restriction during radial rotation from axial direction as refrigerant enters through the flow openings are prevented by the arcuate and convex surface formed in the reinforcing wall, wherein a rapid rotation, consequent pressure drop and flow restriction during radial rotation from circumferential direction as refrigerant enters through the flow openings are prevented by the arcuate and convex surfaces formed in the pillar portions, wherein at least one of the discontinuous portions having a greatest axial extension extends axially through at least one third of a total axial distance between the first face and the second face, and different discontinuous portions have an axial extension different from the greatest axial extension of the at least one of the discontinuous portions.

10. The fixed scroll of claim 9, wherein the discontinuous portions occupy 180 degrees or less of a total circumference of the circumferential wall at the second face of the fixed scroll.

11. The fixed scroll of claim 9, wherein at least one of the discontinuous portions extends axially from the second face to the end wall of the fixed scroll.

12. The fixed scroll of claim 9, wherein the circumferential wall includes at least three of the pillar portions.

13. A scroll compressor for a motor vehicle air conditioning system comprising:

an orbiting scroll having a first spiral structure; and a fixed scroll including:

a plurality of pillar portions extending axially from a first face of the fixed scroll to an opposing second face thereof, each of the plurality of the pillar portions spaced radially outwardly of a second spiral structure, the second spiral structure configured to cooperate with the first spiral structure of the orbiting scroll to define at least one compression chamber of the scroll compressor; and an annular array of spaced flow openings into the compression chamber of the scroll compressor with each of the flow openings formed between adjacent ones of the pillar portions, wherein the fixed scroll further includes a plurality of reinforcing walls provided between and connecting two adjacent ones of the pillar portion, wherein the fixed scroll further includes an arcuate and convex surface extended radially inwardly at a boundary of one of the flow openings, wherein the arcuate and convex surface is formed in the pillar portions and the plurality of reinforcing walls, wherein a rapid rotation, consequent pressure drop and flow restriction during radial rotation from axial direction as refrigerant enters through the flow openings are prevented by the arcuate and convex surface formed in the reinforcing wall, wherein a rapid rotation, consequent pressure drop and flow restriction during radial rotation from circumferential direction as refrigerant enters through the flow openings are prevented by the arcuate and convex surfaces formed in the pillar portions, wherein at least one of the flow openings having a greatest axial extension extends axially through at least one third of a total axial distance between the first face and the second face, and different flow openings have an axial extension different from the greatest axial extension of the at least one of the flow openings.

14. The scroll compressor of claim 13, further comprising a housing defining at least one flow chamber for conveying the refrigerant to at least one of the flow openings, each of the at least one flow chambers disposed radially outwardly of one of the pillar portions of the fixed scroll.

15. The scroll compressor of claim 13, wherein the second face of the fixed scroll is coupled to an end of a housing portion of the scroll compressor with each of the flow openings at least partially defined by the end of the housing portion.

16. The scroll compressor of claim 15, wherein at least one of the pillar portions includes a coupler opening and the end of the housing portion includes at least opening aligned with the at least one of the pillar portions, wherein a coupler is disposed at least partially within the at least one coupler opening and the at least one opening of the housing portion.

* * * * *